US010995912B2

(12) United States Patent
Owens et al.

(10) Patent No.: US 10,995,912 B2
(45) Date of Patent: May 4, 2021

(54) FUEL TRANSFER ADAPTERS

(71) Applicant: ECO-BURNER PRODUCTS LTD., Airport Business Park (IE)

(72) Inventors: Anthony Peter Owens, Wicklow Town (IE); Brian Walter Walsh, Ferrybank (IE)

(73) Assignee: ECO-BURNER PRODUCTS LTD., Waterford (IE)

( * ) Notice: Subject to any disclaimer, the term of this patent is extended or adjusted under 35 U.S.C. 154(b) by 56 days.

(21) Appl. No.: 15/532,075

(22) PCT Filed: Nov. 29, 2015

(86) PCT No.: PCT/IB2015/002235
§ 371 (c)(1),
(2) Date: May 31, 2017

(87) PCT Pub. No.: WO2016/087919
PCT Pub. Date: Jun. 9, 2016

(65) Prior Publication Data

US 2017/0268727 A1 Sep. 21, 2017

(30) Foreign Application Priority Data

Dec. 1, 2014 (GB) ..... 1421319

(51) Int. Cl.
*F17C 13/04* (2006.01)
*B67D 7/04* (2010.01)

(52) U.S. Cl.
CPC ..... *F17C 13/04* (2013.01); *B67D 7/04* (2013.01); *F17C 2205/0373* (2013.01);
(Continued)

(58) Field of Classification Search
CPC ..... F17C 13/04; F17C 2270/0709; F17C 2223/033; F17C 2221/035;
(Continued)

(56) References Cited

U.S. PATENT DOCUMENTS 2,728,509 A * 12/1955 Peterson ..... F23Q 2/52 141/349
3,035,617 A * 5/1962 Breitenstein ..... B65D 83/75 141/349

(Continued)

FOREIGN PATENT DOCUMENTS

| | | |
|---|---|---|
| AU | 5844173 A | 1/1975 |
| WO | WO2011060006 | 5/2011 |
| WO | WO2013099757 | 7/2013 |

OTHER PUBLICATIONS

PCT/IB2015/002235. Applicant: Eco-Burner Products Ltd. International Search Report & Written Opinion (dated Jun. 9, 2016).

*Primary Examiner* — Timothy L Maust
*Assistant Examiner* — James R Hakomaki
(74) *Attorney, Agent, or Firm* — Loza & Loza, LLP; Anthony G. Smyth

(57) ABSTRACT

A fuel transfer adapter for a fuel cartridge, the fuel transfer adapter comprising: an adapter body; at least one fuel filling channel through said adapter body for the passage of fuel from a valve of the fuel cartridge to a fuel tank of an appliance through a filling port of said fuel tank; a fuel cartridge engaging portion at one end of the adapter body, for engaging the adapter body with the valve of the fuel cartridge; and, a port engaging portion at the other end of the adapter body for releasably engaging with the filling port, whereby the fuel transfer adapter incorporates at least one vent for the passage of vapour from the fuel tank to the atmosphere, said at least one vent being configured, in use, to transfer vapour displaced from the fuel tank by the fuel entering therein to the atmosphere.

(Continued)

A method of filling a fuel tank of an appliance comprising the steps of: docking a fuel cartridge equipped with a fuel transfer adapter to a filling port of an appliance; applying a push force between the appliance and the fuel cartridge to open both a port filling valve and a fuel cartridge valve; applying a further push force between the appliance and the cartridge to create a fluid-tight seal between a compliant rim of the fuel transfer adapter and the filling port, and to create a fluid-tight seal between the sealing lip of a port engaging portion of the fuel transfer adapter and a wall of the filling port; allowing fuel to transfer from the fuel cartridge to the fuel tank of the appliance, and displaced vapour to transfer from the fuel tank to the atmosphere through a vent in the fuel transfer adapter; and, undocking the fuel cartridge from the filling port.

13 Claims, 4 Drawing Sheets

(52) U.S. Cl.
CPC ..... *F17C 2221/035* (2013.01); *F17C 2223/0153* (2013.01); *F17C 2223/033* (2013.01); *F17C 2270/0709* (2013.01)

(58) Field of Classification Search
CPC ..... F17C 2205/0373; F17C 2223/0153; F17C 5/02; F17C 2227/04; B67D 7/04
USPC ..... 141/349, 331
See application file for complete search history.

(56) References Cited

U.S. PATENT DOCUMENTS 3,115,907 A * 12/1963 Labat ..... F23Q 2/52 141/295
3,402,747 A * 9/1968 Tissot-Dupont ..... F23Q 2/52 141/348
3,731,718 A * 5/1973 Gramig ..... F16L 29/02 141/384
3,907,012 A * 9/1975 Burke ..... B65D 83/756 141/349
4,207,934 A * 6/1980 Scremin ..... F16L 37/12 141/20
4,266,813 A * 5/1981 Oliver ..... F16L 25/14 285/12
4,277,994 A * 7/1981 Gargrave ..... B21D 28/34 83/133
4,375,864 A * 3/1983 Savage ..... B65D 77/067 222/81
4,611,628 A * 9/1986 Pasternack ..... F16K 1/305 137/509
4,995,417 A * 2/1991 Naku ..... B65D 83/306 137/231
6,129,125 A * 10/2000 Duchon ..... B05B 11/0056 141/18
6,561,237 B1 * 5/2003 Brass ..... F16L 29/02 141/1
7,222,765 B2 * 5/2007 Robinson ..... B25C 1/08 227/10
7,334,598 B1 2/2008 Hollars
7,537,024 B2 * 5/2009 Adams ..... H01M 8/04208 137/614.04
8,171,950 B2 * 5/2012 Colby ..... F16K 1/307 137/15.01
8,408,247 B2 * 4/2013 Pisot ..... F16K 1/306 137/613
2003/0111136 A1 * 6/2003 Vallon ..... F16K 1/303 141/348
2007/0251376 A1 * 11/2007 Toulouse ..... F17C 13/04 91/471
2010/0004619 A1 * 1/2010 Rondeau ..... F16L 37/0985 604/407
2010/0143028 A1 * 6/2010 Chen ..... F17C 13/00 403/314
2012/0091380 A1 * 4/2012 Newman ..... F16K 1/306 251/324
2012/0324920 A1 * 12/2012 Carrubba ..... F25B 45/00 62/77
2013/0256257 A1 * 10/2013 Ho ..... B25C 1/08 215/228
2014/0338385 A1 * 11/2014 Ronga ..... F25B 45/00 62/292

* cited by examiner

FUEL TRANSFER ADAPTERS

This invention relates to fuel transfer adapters, and in particular fuel transfer adapters for use with portable fuel cartridges when filling liquid fuel powered appliances with fuels.

Liquid fuel powered appliances may comprise portable stoves, chafing burners and other food warming devices, or alternatively may comprise handheld work tools such as soldering irons, blow torches, curling tongs, cutting equipment or brazing equipment. These liquid fuel powered appliances may also comprise hot drinks machines employing LPG water heating portable refrigeration appliances for transporting temperature-sensitive products such as foodstuffs and medications, compact portable space heaters for automobiles, off-grid power generation appliances employing the thermo-photoelectric effect, or other liquid fuelled appliances that require liquid fuel replenishment. The liquid fuel in such situations typically comprises liquefied petroleum gas, otherwise known as liquid petroleum gas or LPG. This gas comprises a mixture of hydrocarbon gases that may comprise primarily propane or alternatively primarily butane.

Where the liquid fuel powered appliance is a portable stove, chafing burner or the like, such appliances are typically designed to be transportable and lightweight. This suits their primary use of delivering heat to dishes, such as chafing dishes, in the food service and catering trade, whilst also being used in outdoor situations such as when camping. Volatile Liquid fuel is transferred into a fuel tank of the appliance, under pressure, from a fuel canister or cartridge, for combustion. The liquid fuel store in the appliance may be replenished throughout its useful life using recyclable or disposable cartridges such as an aerosol-type fuel cartridge or can. These cartridges are typically of cylindrical form and constructed from multiple formed sheet metal components to comprise a hermetic pressure vessel. During refuelling, a force-actuated valve at the top of the cartridge enables fuel to flow from the cartridge through a valve stem and connection means to an appliance, but automatically closes to interrupt fuel flow when force on the valve stem is removed.

The principal advantage of these replenishable liquid fuel stoves is convenience. They allow a user to take control of the temperature, the duration, and the cost of providing portable heat for a specific application. The flame resists being blown out by wind, the unit remains safe to touch, and the stove does not require priming prior to use. These stoves are generally maintenance-free and capable of providing immediate high heat output as and when required. By providing a refillable fuel reservoir, cost savings can be made, and environmental issues caused by material and gas wastage and disposal, can be minimised.

However, the refilling operation presents issues of its own. Docking the fuel cartridge or aerosol-type fuel can to the filling port of the appliance is not always intuitive and incorrect docking and orientation of the nozzle can cause fuel leakage during the filling operation. In an attempt to solve this problem, some fuel cartridge suppliers have provided fuel transfer adapters for their aerosol cans and cartridges that are designed to fit with a docking port of an appliance through a unique docking interface. This interface is typically designed to encourage correct orientation, and therefore minimise leakage. However, the high costs of replacing some liquid fuels can lead appliance owners to seek cheaper alternatives, and to therefore attempt to dock generic liquid fuel cans to their appliance for refilling purposes. If the fuel transfer adapter can simply be removed from the original can and mounted onto the generic can, there is little to stop the appliance owner from attempting a cheaper fuel alternative. This use of generic fuel cans is detrimental to the business of the original fuel supplier, whilst also presenting potential safety risks through filling and operating an appliance with fuel that it hasn't been designed for. Such risks include undue susceptibility to flame extinction or light-back on burner faces which can create explosion hazard or equipment damage. In addition, there is often increased risk of carbon monoxide emission from combustion of unauthorised fuels.

The cartridge filling industry also knows ways of tamper-proofing proprietary fuel transfer adapters to make it difficult for users to transfer an adapter from one cartridge to another. These often involve snap-fitting the fuel transfer adapter onto an undercut on the stem of the cartridge valve and sometimes too the installation of a snap-fitted bezel ring onto the hem of the can valve to discourage the use of prying tools to lever off the fuel transfer adapter. However, although these fuel transfer adapters may make the transfer to a generic can difficult, they do not prevent it altogether.

A key issue with existing refillable liquid fuel appliances is the provisions made to vent air and fuel vapours during the filling process. These gases are displaced by the fuel being transferred to the fuel tank within the appliance during the filling process. Typically, vents are provided within the appliance itself, these vents being configured to transfer vapour from the fuel tank to the surrounding atmosphere. Such venting of vapour is regulated in the majority of territories, and these regulations are frequently subject to change. Such small, portable appliances can be relocated from a territory where free venting of fuel tank vapours to the atmosphere is permitted, to another where it is proscribed. Where the vents are provided within the appliance, should a change in the lawful venting requirements occur, the appliance that no longer fits within these revised regulations would be rendered obsolete, being at considerable expense to both appliance users and suppliers.

Where the regulations allow, some venting arrangements are configured to ensure rapid refilling of the fuel tank for efficiency, particularly where the appliance owner has numerous units that require replenishment, and a short time in which to fulfil this. Typically, aerosol-type refuelling cans dock to these appliances using a precision valve assembly which is clinched to the top of the aerosol can after filling with the liquid fuel product. This valve assembly is equipped with a tubular metal or polymer stem which projects at the top of the can and through which the fuel, such as LPG, at a pressure of typically 3 bar at room temperature, is transferred from the can to the fuel tank of the appliance. Flow is initiated by depressing the valve stem by 1 to 2 mm resulting in a free discharge rate to the atmosphere of approx 3 grams of fuel per second.

When transferring pressurised LPG fuel to the empty unvented fuel tank of an appliance, some of the fuel entering the tank boils, generating backpressure. This backpressure rapidly decreases the inflow rate, causing fill times to take many minutes. A slow fill time is often unacceptable to commercial users. This problem is usually alleviated by permitting some venting of fuel vapours in the tank during filling, thus limiting backpressure. The difficulties with facilitating venting are: some carryover of liquid-state fuel in emitted vapour always occurs, resulting in wastage; all fuel emissions during venting pose a fire hazard and/or serious risk of personal injury; venting of a partially-full LPG vessel causes boiling of the liquid fraction, which cools the fuel and causes a reduction in specific volume. In extreme cases where a large amount of venting is combined with over-filling of the fuel tank, a considerable risk of hydrolocking is created, as the chilled fuel equilibrates with the ambient temperature and expands.

In practice, a balance must be struck between rapid refuelling which requires substantial venting, and considerations of economy and safety which require minimal venting. The balance between these conflicting requirements is likely to differ according to national and/or local regulations and to user preference. For reasons of cost containment and user interface simplicity, venting rate in portable LPG-fuelled appliances is normally controlled by an internal fixed orifice in the fuel filling valve assembly which is not designed to be adjustable. This complication would appear to require appliances to be recalled from the field for rebuild and component replacement in the event that venting rate needs to be adjusted up or down, involving substantial administrative and financial burdens.

Fast refuelling causes high levels of vented vapour to be ejected into the surrounding atmosphere, which poses considerable safety issues. In particular, venting large volumes of combustible fuel vapour in the vicinity of other LPG-fuelled portable appliances which may be lit poses a serious risk of personal injury.

Some appliance manufacturers deliberately prevent any venting from taking place during refuelling. This has the disadvantage that it is impractical to fill the tanks in such appliances to the approx 80% fill level that is considered safe.

The prior art shows a number of devices which attempt to address these needs in various ways.

EP2466186A1 (Air Products and Chemicals Limited) discloses a process and apparatus for filling pressurisable containers with pressurized gas by transferring a metered amount of a cryogenic liquid into the container. The apparatus comprises a filling conduit in a separable nozzle apparatus, allowing air and gas to be displaced from the container via either the filling conduit or a separate venting conduit, then sealing the container and allowing the liquid to evaporate and pressurize the container. The disclosure is directed to reducing health and safety risks related to cryogen backflow and spitting, and to minimizing evaporative loss of cryogen during filling. This document does not disclose the use of controlled throttling of flow through the venting conduit as a means of regulating evaporative loss, nor does it teach the manufacture of the nozzle assembly in a single low cost component, nor does it anticipate the use of regulated venting apparatus for filling containers with non-cryogenic liquid fillings, such as LPG.

GB1147341 (Enzinger Union Werke AG) discloses an apparatus for high-speed filling of gas-containing liquids into bottles at elevated pressure. The conflict between speed of filling and minimisation of loss of valuable liquid is explicitly referred to. Simultaneous control of liquid fill line and venting line pressure are employed to resolve this, and in particular, the pressure differential between these lines is managed throughout the filling cycle. The apparatus comprises a means of controlling venting line pressure, in part by use of an adjustable or interchangeable restrictor orifice or nozzle. This document is concerned with minimising air entrainment into the dispensed liquid in bottles. The cost, complexity and bulk of the valving and mechanics which comprise the filling head disclosed, would be wholly unsuitable for deployment as part of a fuel container.

Whilst the prior art appears to address the problems associated with the use of cheaper generic fuel cartridges through unique docking interfaces, fuel transfer adapters and suchlike, they do not appear to address the issues with counterfeits of these docking interfaces and fuel transfer adapters. No efforts have been made to provide for managed venting during the filling process to meet evolving territorial requirements and to allow ongoing control of the refuelling process by the fuel supplier. They do not offer a tamper-resistant refuelling interface nor a tamper-resistant fuel transfer adapter to discourage the use of generic fuel cartridges.

Preferred embodiments of the present invention aim to provide a means of controlling the venting rate of a fuel tank during the fuel tank filling process that adheres to the venting regulations within a particular territory and to provide this means of controlling the venting rate through a fuel transfer adapter. The present invention also aims to provide a substantially tamperproof means of refilling fuel tanks for commercial reasons and to ensure user safety. The present invention aims to strike a balance between refuelling rate and safe levels of fuel gas emission from a particular fuel tank within a particular territory. Therefore the present invention aims to provide effective control of emission levels, prevent counterfeiting of consumables, and enforce a safe, regulated filling rate. In a further embodiment, the present invention aims to provide a fuel tank filling system, whereby the fuel transfer adapter is configured to vent gas at a desired rate from the fuel tank of an appliance.

According to one aspect of the present invention, there is provided a fuel transfer adapter for a fuel cartridge, the fuel transfer adapter comprising:

- an adapter body;
- at least one fuel filling channel through said adapter body for the passage of fuel from a valve of the fuel cartridge to a fuel tank of an appliance through a filling port of said fuel tank;
- a fuel cartridge engaging portion at one end of the adapter body for engaging the adapter body with the valve of the fuel cartridge; and,
- a port engaging portion at the other end of the adapter body for releasably engaging with the filling port, whereby the fuel transfer adapter incorporates at least one vent for the passage of vapour from the fuel tank to the atmosphere, said at least one vent being configured, in use, to transfer vapour displaced from the fuel tank by the fuel entering therein to the atmosphere.

In some embodiments, the vent may comprise a channel within the adapter body.

In some embodiments the channel may comprise a cylindrical recess about the periphery of the fuel filling channel and sharing the same longitudinal axis as the fuel filling channel. The cylindrical recess may incorporate at least one vent restrictor for controlling the flow of vapour from within the cylindrical recess to the atmosphere.

In some embodiments, the at least one vent restrictor may comprise an orifice within a wall of the adapter body. The orifice may be between 0.01 mm and 6 mm in diameter. This addresses the problem of meeting the various and changing venting requirements of different territories.

In some embodiments, the adapter body may comprise a sealing lip about the periphery configured, in use, to provide a fluid-tight seal with the filling port when the fuel transfer adapter is engaged with said filling port.

In some embodiments, the port-engaging portion may have a port engaging end. The port engaging end may incorporate a compliant rim configured, in use, to form a fluid-tight seal with the filling port when the fuel transfer adapter is engaged with said filling port.

In some embodiments, the sealing lip and compliant rim may be configured, in use, to form a fluid-tight seal with the filling port under an operating thrust force exerted during filling.

In some embodiments, the adapter body may be configured, in use, to support the fuel cartridge in the filling port such that the longitudinal axis of the fuel cartridge is substantially parallel with the direction of insertion into the filling port.

In some embodiments, the fuel cartridge engaging portion may comprise a skirt.

In some embodiments, the skirt may be configured to engage with the fuel cartridge through a friction fit. Alternatively, the skirt may incorporate one or more projections for engaging with the fuel cartridge through a snap fit.

In some embodiments, the fuel transfer adapter may comprise a polymer.

In some embodiments, the fuel transfer adapter may be injection moulded as one piece.

According to the invention, there is also provided a fuel cartridge which incorporates the fuel transfer adapter as hereinbefore described.

According to a further aspect of the present invention, there is provided a method of filling a fuel tank of an appliance comprising the steps of:

i. docking a fuel cartridge equipped with a fuel transfer adapter to a filling port of an appliance;
ii. applying a push force between the appliance and the fuel cartridge to open both a port filling valve and a fuel cartridge valve;
iii. applying a further push force between the appliance and the cartridge to create a fluid-tight seal between a compliant rim of the fuel transfer adapter and the filling port, and to create a fluid-tight seal between the sealing lip of a port engaging portion of the fuel transfer adapter and a wall of the filling port;
iv. allowing fuel to transfer from the fuel cartridge to the fuel tank of the appliance, and displaced vapour to transfer from the fuel tank to the atmosphere through a vent in the fuel transfer adapter; and,
v. undocking the fuel cartridge from the filling port.

For a better understanding of the invention and to show how embodiments of the same may be carried into effect, reference will now be made, by way of example, to the accompanying diagrammatic drawings, in which.

Figure 4:
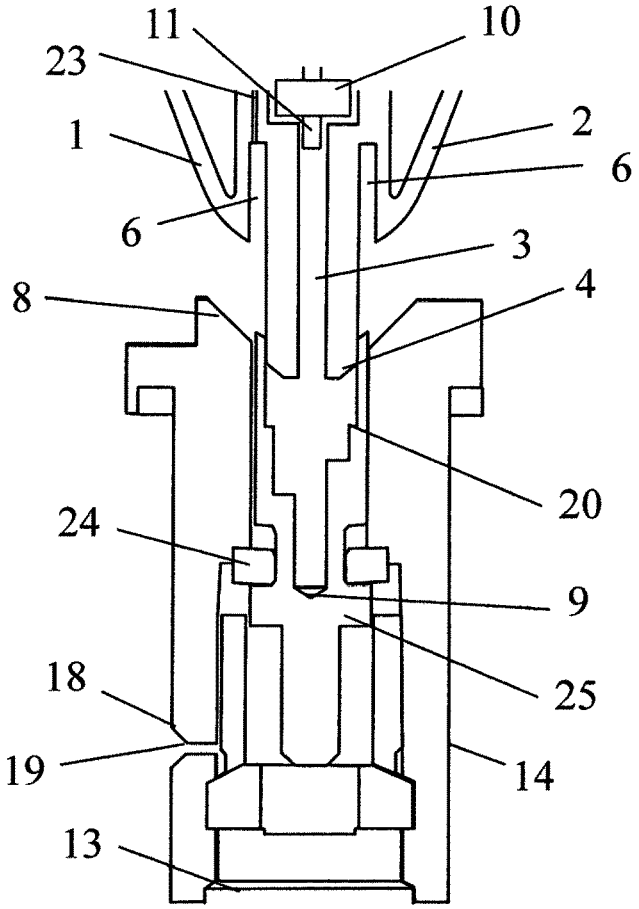
FIG. 4 shows a diagrammatic view of the fuel transfer adapter being inserted into a filling port of a fuel tank.
Figure 7:
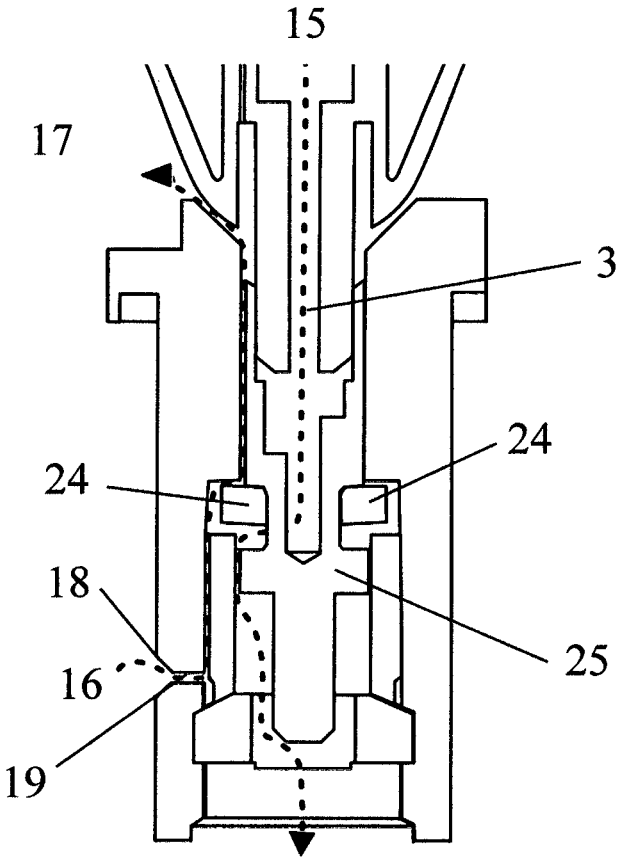
Figure 8:
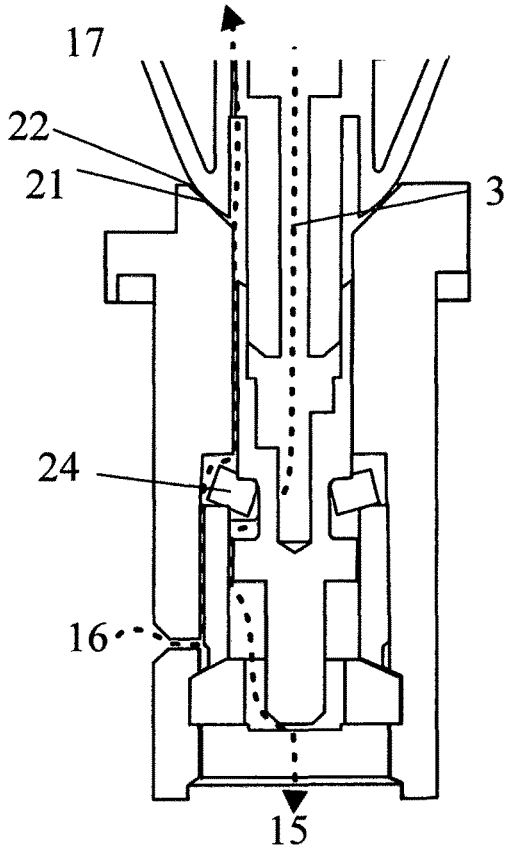

FIG. 7 shows the diagrammatic view of FIG. 4, showing fuel entering the fuel tank, and displaced vapour passing out of the filling port to the atmosphere via a venting passageway uncovered by the displacement of a port sealing washer relative to the filling port housing; and, FIG. 8 shows the diagrammatic view of FIG. 7 with fuel transfer adapter fully inserted into the filling port, a sealing lip in fluid-tight arrangement with a wall of the filling port, and displaced vapour passing to the atmosphere through a vent in the fuel transfer adapter.

Figure 9:
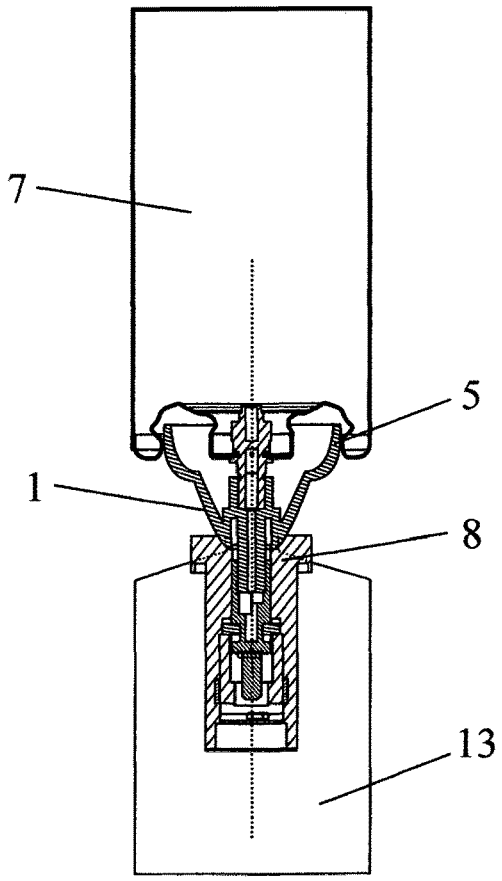

FIG. 9 shows a diagrammatic view of one embodiment of fuel transfer adapter, engaged with a typical fuel cartridge, the fuel transfer adapter and therefore the fuel cartridge shown in an inverted condition, engaged with a filling port of a fuel tank.

In the figures like references denote like or corresponding parts.

It is to be understood that the various features that are described in the following and/or illustrated in the drawings are preferred but not essential. Combinations of features described and/or illustrated are not considered to be the only possible combinations. Unless stated to the contrary, individual features may be omitted, varied or combined in different combinations, where practical.

Figure 1:
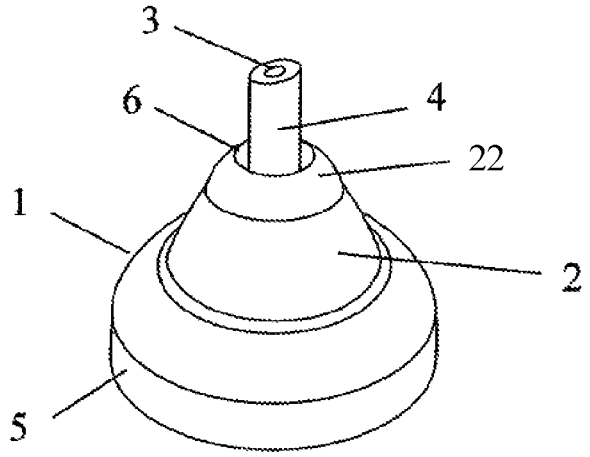
FIG. 1 shows one embodiment of a fuel transfer adapter in isometric view.

FIG. 1 shows a fuel transfer adapter 1 for supporting the transfer of a fuel from a fuel cartridge to a fuel tank. The fuel transfer adapter 1 comprises an adapter body 2. The adapter body 2 may be of any suitable shape so as to perform the required fuel transfer, to provide an aesthetic shape, whilst also to support the fuel transfer process. The adapter body 2 may therefore be substantially cylindrical, or substantially conical, or any other such shape that fulfils these requirements. The adapter body 2 may also incorporate means to support a fuel cartridge in an inverted position, when mounted within a fuel tank, to ensure that leakages are unlikely to occur during the filling process.

The adapter body 2 incorporates at least one fuel filling channel 3. This fuel filling channel 3, when in use filling a fuel tank, is fluidly connected to a fuel store within a fuel cartridge 7, whilst also being fluidly connected to a fuel tank within an appliance 14. The fuel filling channel 3 may comprise a pipe, tube or similar arrangement that allows for an efficient transfer of liquid fuel from fuel cartridge 7 to fuel tank. The fuel filling channel 3 may run down the central axis of the adapter body 2. The fuel transfer adapter 1 may incorporate more than one fuel filling channel 3, not shown.

The adapter body 2 incorporates a port engaging portion 4 that projects from the adapter body 2, and provides means to connect the fuel filling channel 3 with a fuel tank. The port engaging portion 4 may therefore also incorporate the fuel filling channel 3, to continue the path of the fuel filling channel 3 to fluidly connect with a filling port of a fuel tank. The port engaging portion 4 in one embodiment is substantially oval in cross-section. This shape is configured to assist with orientation and docking of the fuel transfer adapter 1 and therefore the fuel cartridge within the filling port of the appliance. The filling port of the appliance is provided with a corresponding shaped socket to engage with the port engaging portion 4. The fuel cartridge with fuel transfer adapter 1 must be inverted to align with the filling port. The non-circular cross-sectional shape of the filling port 20 is designed to frustrate attempts to fill the appliance using non-proprietary fuel cartridges of unapproved fuel.

The port engaging portion 4 may be provided with a compliant rim or sealing land, not shown. This compliant rim seals the port engaging portion 4 to a mating wall or walls in the filling port to prevent the fuel from leaking. The compliant rim may be suitably shaped to mate with the filling port, and to ensure that a sufficient compliant rim sealing pressure is maintained against the mating surfaces of the filling port when a filling force is exerted by a user. The compliant rim may comprise a flexible material, or may be configured to flex under a force.

The fuel transfer adapter 1 is also provided with a fuel cartridge engaging portion 5. This fuel cartridge engaging portion 5 in one embodiment comprises an outer skirt and a central hub that are configured to engage with one or more features on the outlet end of a fuel cartridge. This engagement may for example employ combinations of snap fits, friction fits, adhesive bonding, heat staking, welding and crimping. In an alternative embodiment, the fuel transfer adapter 1 may be formed as an integral part of the fuel cartridge.

Figure 2:
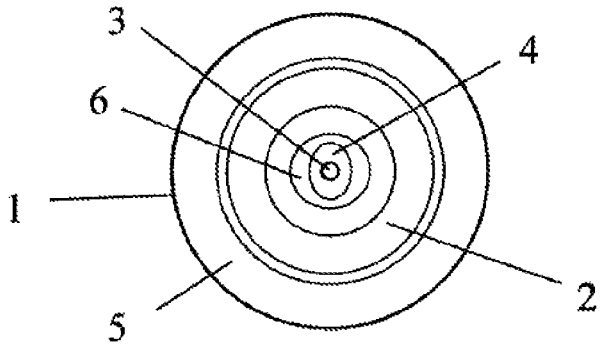
FIG. 2 shows the fuel transfer adapter of FIG. 1 in plan view, showing one embodiment of a vent.

As shown in FIG. 2, the fuel transfer adapter 1 comprises at least one vent 6. This vent 6 is configured to allow the passage of vented gases from the fuel tank of the appliance during the filling process. The at least one vent 6 may comprise a channel, or orifice. The channel may run adjacent to the fuel filling channel 3. The vent 6 may be substantially cylindrical and surround the fuel filling channel 3, and share the same longitudinal axis as the fuel filling channel 3. Where the vent 6 is an orifice or hole, this hole may be situated within the adapter body 2 of the fuel transfer device 1, or within a wall of the fuel filling channel 3. The vent 6 is configured to be fluidly connected to the fuel tank of the appliance at one end, to allow for the passage of displaced vapours in the fuel tank during the filling process, whilst also being fluidly connected to the surrounding atmosphere, to vent these gases to the surroundings of the fuel transfer adapter 1.

The vent 6 may incorporate at least one venting channel restrictor 23, as shown in FIG. 4. This venting channel restrictor 23 may comprise an orifice or further channel, configured to throttle the flow of vapour through the vent 6 and to the surrounding atmosphere 17. The diameter of the throttling orifice may be in the range 0.01 mm to 6 mm according to the requirements of vapour permitted to be released into the atmosphere within a particular region, or according to the requirements of a particular appliance containing a fuel tank. Thus the rate of flow of the venting gases can be altered by using a different fuel transfer adapter 1 that comprises a venting channel restrictor 2 of a lesser or greater throttling effect.

The dimensions of the venting channel restrictor 23 therefore have a significant impact on the performance of the vent 6, and the quantity of vapour that can be vented at any one time. Territorial regulations are likely to regulate the venting of such flammable, noxious gases and these regulations are subject to amendment by each territory. A range of fuel transfer adapters 1 with different degrees of vent throttling could be made available to ensure compliance over time with evolving venting regulations within a territory of use, up to and including the elimination of venting entirely.

Figure 3A:
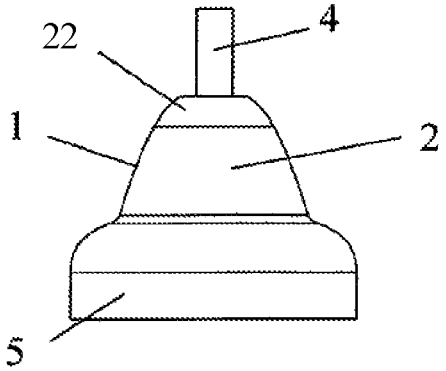
FIG. 3A shows the fuel transfer adapter of FIG. 1 in front view.
Figure 3B:
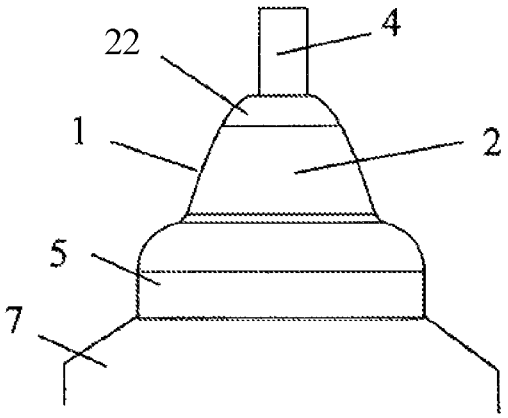
FIG. 3B shows the fuel transfer adapter of FIG. 1 in side elevation view when attached to a fuel cartridge.

FIGS. 3A and 3B show a side view and end view of the fuel transfer adapter 1, showing the ovoid shape of one embodiment of port engaging portion 4. FIG. 3B shows the fuel transfer adapter 1 when secured to a fuel cartridge 7.

Figure 5:
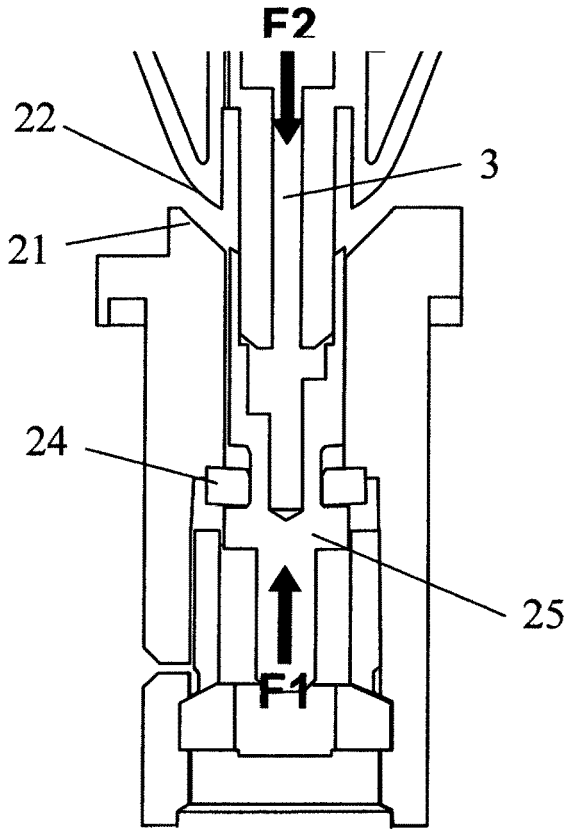
FIG. 5 shows the diagrammatic view of FIG. 4, with fuel transfer adapter further inserted into the filling port and showing the main forces acting between the fuel transfer adapter and the port pintle.

FIG. 4 shows an inverted fuel cartridge 7 provided with a fuel transfer adapter 1, and engaged through a port filling valve 9 of a filling port 8. The fuel transfer adapter 1 is also configured to engage with the fuel cartridge valve 10 and fuel cartridge filling stem 11 of the fuel cartridge 7, to form a pressing member that causes fuel to expel from the fuel cartridge 7. FIG. 4 shows the fuel transfer adapter 1 starting to be inserted into the filling port 8. FIG. 5 shows the fuel transfer adapter 1 having been further inserted into the filling port 8, showing an insertion force F2 being applied by a user pressing the fuel cartridge 7 and therefore the fuel transfer adapter 1 into the filling port 8. Also shown is a reactive force F1 of a spring within the filling port 8, this spring not shown in the drawings.

Figure 6:
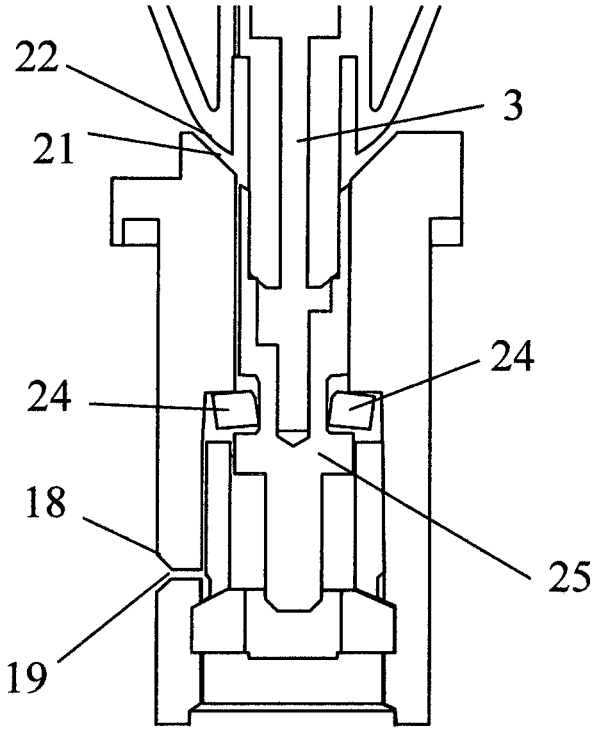
FIG. 6 shows the diagrammatic view of FIG. 4, showing the fuel transfer adapter yet further inserted into the filling port, showing the displacement of a port sealing washer relative to a port pintle within the filling port, uncovering a fuel admission passageway on the port pintle.

FIG. 5 shows a sealing lip 22 of the fuel transfer adapter 1 approaching engagement with a port side wall 21 of the filling port. Also shown is the initial displacement of a port washer 24 by the port pintle 25 that governs entry of the fuel into the fuel tank 13. FIG. 6 shows the sealing lip 22 of the fuel transfer adapter 1 even closer to being engaged with the port side walls 21, and the port washer 24 having been further displaced by the port pintle 25. FIG. 7 shows the fuel 15 flowing from the fuel transfer adapter 1 of the fuel cartridge 7, down the fuel filling channel 3 and into the filling port 8 of the appliance 14, the port washer 24 having been sufficiently displaced by the port pintle 25 to allow the passage of fuel 15 to take place. This fuel 15 enters the fuel tank 13, and displaces the gases, comprising air and vapour, within the fuel tank 13. These gases 16 find a suitable escape route out through a fuel tank vent 18, and through one or more fuel tank vent restrictors 19 to the atmosphere 17. This initial flow of gas 16 is not yet caught by the vent 6 within the fuel transfer adapter 1.

Inside the appliance 14 the port filling valve 9 is connected to the fuel tank 13 via a channel which generally includes one or more orifices or other features restrictive to liquid fuel 15 flow. These restrictions are represented in aggregate by a filling restrictor 20. Venting arrangements for gas 16 inside the fuel tank 13 as it is displaced by liquid fuel 15 are normally provided in such appliances 14. The pressurised vapour/air mixture in the fuel tank 13 is connected to the atmosphere 17 via a separate pathway or fuel tank vent 18 to that taken by arriving fuel 15, and will include one or more orifices or other features restrictive to flow of gas 16, represented in aggregate by the fuel tank venting restrictor 19. The purpose of this venting pathway is to reduce internal fuel tank pressure to below the pressure in the fuel cartridge 7, enabling expeditious filling while avoiding undue loss of fuel.

This fuel tank vent 18 is therefore within the appliance 14, and therefore it is not easy to alter the performance of this fuel tank vent 18 in order to meet a change in vented vapour regulations for a territory. Or should an appliance 17 be moved from one territory with a specific venting regulation to another with a different venting regulation, the appliance 14 may be rendered obsolete.

FIG. 8 shows the arrangement of FIG. 7 but with a further force having been applied in a downward direction to the fuel cartridge 7, and therefore to the fuel transfer adapter 1. This further force moves a second sealing lip 22 about the periphery of the adapter body 2 of the fuel transfer adapter 1 into sealing engagement with the port side walls 21 of the filling port 8. This sealing lip 22 may comprise a surface of the adapter body 2 that is configured to mate with the surface of the port side walls 21 in a fluid-tight arrangement. The sealing lip 22 may comprise an additional material such as a rubber or elastomeric lip that provides some compliance to support the sealing process, not shown. The surface of the adapter body 2 may be shaped to form the sealing lip 22 or sealing land when engaged with the filling port 8 of the appliance 14.

In FIG. 8, with the sealing lip 22 providing a seal with the filling port 8, the displaced vapour 16 passes through the fuel tank vent 18 and fuel tank venting restrictor 19, then is diverted into the vent 6 of the fuel transfer adapter 1. In an embodiment where the vent 6 comprises a channel and venting channel restrictor 23, the vapour 16 must flow to the surrounding atmosphere 17 out through this channel and venting channel restrictor 23 arrangement. The vent 6 may comprise more than one venting channel restrictor 23, not shown. The size of this venting channel restrictor 23 controls the volumetric flow rate of vapour 16 from the fuel tank 13 of the appliance 14, strongly influencing the fuel tank pressure and therefore the fuel inflow rate. FIG. 9 shows the fuel transfer adapter 1 with fuel cartridge engaging portion 5 engaged with a fuel cartridge 7. The fuel cartridge 7 and therefore the fuel transfer adapter 1 are shown in an inverted condition, and releasably engaged with the filling port 8 of a fuel tank 13 of an appliance 14.

The flow resistance of the venting channel restrictor 23 is substantially greater than that of the internal aggregate venting restriction 19. The flow resistance of restrictor 23 therefore dominates venting rate from the fuel tank 13, and thus the time required to refuel the fuel tank using a pressurised fuel canister.

By providing the vent 6 within the fuel transfer adapter 1, it becomes an easy process to replace the fuel transfer adapter 1 to alter the venting performance of the appliance 14. The fuel transfer adapter 1 may comprise a one-piece, injection moulded, polymer component that is extremely cost-effective to manufacture. Upon a change of venting requirements, the fuel transfer adapter 1 can be simply replaced with an alternative fuel transfer adapter 1 that incorporates the vent 6 and therefore the venting channel restrictor 23 to meet these requirements. The fuel transfer adapter 1 is effectively a disposable component of the system. The fuel transfer adapter 1 may be recyclable.

This proprietary filling system in one embodiment may be used for refuelling portable LPG-fuelled appliances with liquid fuels. By embodying this component as a custom fuel transfer adapter 1 fitted to fuel cartridges 7 such as aerosol-type fuel cans and used to dock to the filling port 8 of the appliance 14, high levels of ongoing control of the refuelling process can be enforced by the supplier of the fuel stocks.

In addition the fuel transfer adapter 1 discourages use of potentially damaging counterfeit fuels by end-users of the relevant appliances 14 such as LPG-fuelled appliances. These portable LPG-powered appliances may include but are not limited to hand-held work tools such as soldering irons, blowtorches, curling tongs, cutting and brazing equipment. It also includes but is not limited to certain compact stoves and food warmers.

The fuel transfer adapter 1 resolves the conflict between desire for locally-adjustable venting rate and inaccessibility/inadvisability of the venting adjustment by end users by relocating the vent 6 controlling venting rate from inside the appliance to the fuel transfer adapter 1 used for refuelling. It does this by: embodying venting control in a cheap disposable external component, supplied with refuelling fuel cartridges, in place of an internal inaccessible orifice; comprising a moulded component that adds no significant cost to the can adapter; comprising a fixed orifice within a tamper-resistant component it can be supplied in a range of different venting rates, or indeed with no venting at all, as appropriate to the needs of each territory; should it become necessary to alter the venting rate of all appliances within a territory, no field recall is required; provide variants of the can adapter with differing venting rates simply by changing the orifice size and resistance.

Upon manufacture of the fuel transfer adapter 1, the venting rates of each unit are controlled by an interchangeable core pin in the mould tool of an injection moulding machine. Colour coding of the moulding or ink-jet printing onto the exterior of the moulding can be used to differentiate visually identical can adapters of differing venting characteristics.

The tamper-resistant installation of the fuel transfer adapter 1 onto the fuel cartridge 7 combined with a unique filling adapter for the appliance 14 discourages end-users from recycling fuel transfer adapters 1 from obsolete empty fuel cartridges 7 onto non-approved fuel cartridges with different vapour pressure, filling behaviours, combustion characteristics or purity. These features of the fuel transfer adapter 1 also discourage end-users from omitting the fuel transfer adapter 1 entirely and performing refuelling directly from fuel cartridge 7 with unregulated venting.

The overall effect of the fuel transfer adapter 1 as part of the appliance refuelling system is that the manufacturer of the appliance 14 and the fuel cartridges 7 has a high degree of control over how refuelling is performed by end-users, and can adapt this independently in different territories over time should this become necessary.

The method of filling a fuel tank 13 of an appliance 14 may comprise the steps of initially docking a fuel cartridge 7 equipped with a fuel transfer adapter 1 to a filling port 8 of an appliance 14. The user applies an initial force F2 to open both the filling port valve 9 and fuel cartridge valve 10. This starts the flow of fuel 15 to the fuel tank 13. When the user applies a slightly greater push force F2, a fluid-tight seal is created between the sealing lip 22 and the port side walls 21. The displaced vapour 16 from the fuel tank 13 is transferred to the atmosphere 17 through the vent 6 in the fuel transfer adapter 1.

In one embodiment of the invention the refuelling completion signal is the appearance of atomized liquid emissions in the vapour 16. In another embodiment the refuelling completion signal is a change in the character of the noise emission from the vent 6 optionally accompanied by perceptible vibration of the fuel cartridge 7. In a further embodiment the refuelling completion signal is provided by the measured weight of the appliance 14 falling within a desired range. In yet another embodiment of the invention the refuelling completion signal is provided by a liquid fuel level indicator, not shown.

The refuelling control system disclosed herein may be applied to any consumable replenishment or dispensing operation where effective control of emission levels, or counterfeiting of consumable, or enforcement of safe or regulated filling rate is desirable. Examples include but are not limited to: the infusion of hot water through single-use, individual branded coffee packs at a controlled rate, where flavour and strength of a drink is a function of infusion rate; fuel transfer between LPG vessels where for safety reasons concentration of vented vapour in ambient air needs to be maintained below a combustion threshold; and, in certain types of domestic hot water cylinder installations in elevated locations, where cold water replenishment rate is less than the water abstraction rate, and where a danger of pump cavitation or tank buckling due to sub-atmospheric pressure can arise.

The invention claimed is:

1. A fuel transfer adapter for a fuel cartridge, the fuel transfer adapter comprising:

an adapter body;

at least one fuel filling channel through said adapter body for the passage of fuel from a valve of the fuel cartridge to a fuel tank of an appliance through a filling port of said fuel tank;

a fuel cartridge engaging portion located at one end of the adapter body, the fuel cartridge engaging portion comprising a skirt configured to engage with the fuel cartridge through a friction fit or a snap fit, wherein the fuel cartridge engaging portion is configured to engage the adapter body with the valve of the fuel cartridge when the adapter body is fitted to the fuel cartridge; and a port-engaging portion that projects from the other end of the adapter body, the port-engaging portion being configured for releasably engaging with the filling port, whereby the fuel transfer adapter incorporates at least one vent for the passage of vapor from the fuel tank to the atmosphere, said at least one vent being configured, in use, to transfer vapor displaced from the fuel tank by the fuel entering therein to the atmosphere, wherein the at least one vent is further configured to control flow rate of fuel from the fuel cartridge to the fuel tank, wherein the at least one vent comprises a channel within the adapter body, the channel comprising a substantially cylindrical annular recess about the periphery of the fuel filling channel, and wherein the annular recess incorporates a vent restrictor for controlling the flow of vapor from within the cylindrical annular recess to the atmosphere.

2. A fuel transfer adapter according to claim 1, wherein the vent restrictor comprises an orifice or further channel.

3. A fuel transfer adapter according to claim 2, wherein the vent restrictor is configured to throttle the flow of vapor through the at least one vent to the atmosphere.

4. A fuel transfer adapter according to claim 1, wherein the cylindrical recess incorporates at least one vent restrictor for controlling the flow of vapor from within the cylindrical recess to the atmosphere and the at least one vent restrictor comprises an orifice within a wall of the adapter body.

5. A fuel transfer adapter according to claim 1, wherein the adapter body comprises a sealing lip about the periphery configured, in use, to provide a fluid-tight seal with the filling port when the fuel transfer adapter is engaged with said filling port.

6. A fuel transfer adapter according to claim 1, wherein a port-engaging end of the port-engaging portion incorporates a compliant rim configured, in use, to form a fluid-tight seal with the filling port when the fuel transfer adapter is engaged with said filling port.

7. A fuel transfer adapter according to claim 5, wherein a port-engaging end of the port-engaging portion incorporates a compliant rim configured, in use, to form a fluid-tight seal with the filling port when the fuel transfer adapter is engaged with said filling port, whereby the sealing lip and compliant rim are configured, in use, to form a fluid-tight seal with the filling port under an operating thrust force exerted during filling.

8. A fuel transfer adapter according to claim 1, whereby the adapter body is configured, in use, to support the fuel cartridge in the filling port such that the longitudinal axis of the fuel cartridge is substantially parallel with a direction of insertion into the filling port.

9. A fuel transfer adapter according to claim 1, wherein the fuel cartridge engaging portion comprises a tubular hub configured to engage with a valve stem of the fuel cartridge through a snap fit or an interference fit.

10. A fuel transfer adapter according to claim 1, wherein the skirt is an outer skirt and wherein the fuel cartridge engaging portion further comprises a central hub configured to engage with a valve stem of the fuel cartridge.

11. A method of filling a fuel tank of an appliance comprising the steps of:

docking a fuel cartridge equipped with a fuel transfer adapter to a filling port of an appliance, wherein the fuel transfer adapter comprises a fuel cartridge engaging portion that has a skirt configured to engage with the fuel cartridge through a friction fit or a snap fit;

applying a push force between the appliance and the fuel cartridge to open both a port filling valve and a fuel cartridge valve;

applying a further push force between the appliance and the cartridge to create a fluid-tight seal between a compliant rim of the fuel transfer adapter and the filling port, and to create a fluid-tight seal between a sealing lip of a port engaging portion of the fuel transfer adapter and a wall of the filling port;

allowing fuel to transfer from the fuel cartridge to the fuel tank of the appliance, and displaced vapor to transfer from the fuel tank to the atmosphere through a vent in the fuel transfer adapter, wherein the vent is configured to control flow rate of fuel from the fuel cartridge to the fuel tank; and undocking the fuel cartridge from the filling port, wherein the vent comprises a channel within the fuel transfer adapter, the channel comprising a substantially cylindrical annular recess about the periphery of the fuel filling channel, and wherein the annular recess incorporates at least one vent restrictor configured to control the flow of vapor from within the cylindrical recess to the atmosphere.

12. A fuel transfer adapter for a fuel cartridge, the fuel transfer adapter comprising:

an adapter body;

at least one fuel filling channel through the adapter body and configured to provide for passage of fuel from a valve of the fuel cartridge to a fuel tank through a filling port of the fuel tank;

a fuel cartridge engaging portion located at one end of the adapter body, the fuel cartridge engaging portion comprising a skirt configured to engage with the fuel cartridge through a friction fit or a snap fit, wherein the fuel cartridge engaging portion is configured to engage the adapter body with the valve of the fuel cartridge when the adapter body is fitted to the fuel cartridge;

a port-engaging portion that projects from the other end of the adapter body, the port-engaging portion being configured for releasably engaging with the filling port; and at least one vent configured to transfer vapor displaced from the fuel tank by the fuel entering therein to the atmosphere from the fuel tank to the atmosphere, wherein the at least one vent is further configured to control flow rate of fuel from the fuel cartridge to the fuel tank; and a vent restrictor configured to control flow of vapor from within a substantially cylindrical recess in the at least one vent to the atmosphere, the substantially cylindrical recess being provided about a periphery of the fuel filling channel.

13. A fuel transfer adapter according to claim 12, wherein the vent restrictor is configured to throttle the flow of vapor through the at least one vent to the atmosphere.

* * * * *